US007548721B2

(12) United States Patent
Isozaki

(10) Patent No.: US 7,548,721 B2
(45) Date of Patent: Jun. 16, 2009

(54) SHEET TRANSFERRING DEVICE AND IMAGE FORMING DEVICE

(75) Inventor: Toshihiro Isozaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 29 days.

(21) Appl. No.: 11/414,311

(22) Filed: May 1, 2006

(65) Prior Publication Data

US 2006/0251452 A1 Nov. 9, 2006

(30) Foreign Application Priority Data

May 9, 2005 (JP) ..... 2005-136153

(51) Int. Cl.
*G03G 15/00* (2006.01)

(52) U.S. Cl. ..... 399/388; 399/396; 271/270

(58) Field of Classification Search ..... 399/388, 399/396, 68; 271/270
See application file for complete search history.

(56) References Cited

U.S. PATENT DOCUMENTS

| | | | | |
|---|---|---|---|---|
| 3,591,846 | A * | 7/1971 | Schaffer | 307/31 |
| 3,948,510 | A * | 4/1976 | Iwamoto et al. | 271/258.03 |
| 5,186,449 | A * | 2/1993 | Ohmi et al. | 271/10.03 |
| 5,397,107 | A * | 3/1995 | Wolog et al. | 271/10.04 |
| 5,437,004 | A * | 7/1995 | Miyasaka et al. | 358/1.12 |
| 5,482,265 | A * | 1/1996 | Nakazato et al. | 271/242 |
| 6,026,257 | A * | 2/2000 | Takami et al. | 399/66 |
| 6,203,003 | B1 * | 3/2001 | Sato et al. | 271/3.01 |
| 6,533,263 | B2 * | 3/2003 | Tamura | 271/10.01 |
| 6,554,275 | B1 * | 4/2003 | Tranquilla | 271/259 |
| 6,757,515 | B2 * | 6/2004 | Ueda | 399/396 |
| 2005/0127597 | A1 * | 6/2005 | Sano et al. | 271/258.01 |

FOREIGN PATENT DOCUMENTS

| | | |
|---|---|---|
| JP | 5-338845 | 12/1993 |
| JP | 7-261485 | 10/1995 |
| JP | 11-165906 | 6/1999 |
| JP | 2001-206583 | 7/2001 |

OTHER PUBLICATIONS

Partial Translation of JP 01-236131.

* cited by examiner

*Primary Examiner*—Leslie J Evanisko
*Assistant Examiner*—Matthew G Marini
(74) *Attorney, Agent, or Firm*—Oblon, Spivak, McClelland, Maier & Neustadt, P.C.

(57) ABSTRACT

A sheet transferring device includes a feeding roller configured to feed a sheet; a transferring roller configured to transfer the sheet to the feeding roller; a sheet sensor configured to detect the sheet at a sheet transferring part from the transferring roller to the feeding roller; a measuring part configured to measure an interval of a rear end of a prior sheet and a head end of a following sheet based on a sheet detection signal of the sheet sensor; and a transferring control part configured to adjust a sheet transferring speed of the transferring roller so that the interval between the prior sheet and the following sheet is adjusted to a set value as corresponding to the interval measured by the measuring unit.

5 Claims, 8 Drawing Sheets

SHEET TRANSFERRING DEVICE AND IMAGE FORMING DEVICE

BACKGROUND OF THE INVENTION

1. Field of the Invention

The present invention generally relates to sheet transferring devices and image forming devices, and more specifically, to a sheet transferring device whereby plural sheets are transferred at a constant pitch in sequence, the sheet transferring device being used for a printer, copier, facsimile, or the like, and an image forming device having the sheet transferring device.

2. Description of the Related Art

A printer, copier, facsimile, or the like is used as an image forming device wherein a sheet is transferred to an image forming position and an image is formed on the sheet. In such an image forming device, if an image forming operation of an imaging system and operation of a sheet transferring device sending the sheet to the image forming position are not coordinated, an image offset is generated on the sheet. In continuous printing or continuous copying wherein plural sheets are continuously sent in turn so that image forming is made for each sheet, if a gap between a sheet and the following sheet is not constant, an image offset is generated.

If a transferring speed is different from a designed speed due to adhesion of dust, frictional wear of a transferring roller, or the like, the image offset may be generated. In addition, even if the transferring roller is new, when printing is performed continuously, a member of the transferring roller may expand or contract due to temperature change in the device, so that the designed speed may not be maintained.

Japanese Patent Application Publication No. 5-338845 discloses that difference between assumed time and measured transferring time is corrected by changing the transferring speed when the next sheet is transferred. More specifically, a feeding speed is adjusted so that a measured feeding time at a certain distance when the sheet is fed from a resist roller to a transferring position is a standard time. In other words, the feeding speed is adjusted to the standard speed.

Japanese Patent Application Publication No. 7-261485 discloses a sheet transferring device having a sheet sensor provided between a resist roller and a transferring position. A time when the sheet sensor detects the sheet sent from the resist roller at a low speed is measured. When the sensor detects the sheet, rotation of the resist roller is stopped. The difference between a standard time and a measured time is calculated. The resist roller is re-driven at the timing corresponding to the difference so that the sheet is adjusted to an image position on a photosensitive body and fed.

Japanese Patent Application Publication No. 11-165906 discloses a sheet transferring device having the following structure. In order to make a gap between sheets continuously fed securely constant, a time from when a sheet starts being fed from a resist roller to a transferring position to a time when a head end of the following sheet is detected by a detecting sensor is measured. If the measured time is shorter than the standard time, a paper feeding roller is stopped based on the difference.

Japanese Patent Application Publication No. 2001-206583 discloses an image forming apparatus having a determination sensor provided upstream of the resist roller so that a fed sheet reaches the resist roller at a standard timing. A sheet transferring speed upstream of the resist roller is adjusted corresponding to an offset amount against designated timing, which timing is when the determination sensor detects the sheet.

In a case where the sheet are fed from a paper feeding cassette, the head end of every sheet is scattered for every sheet. Hence, even if the sheets are transferred at an assumed speed, a transferring gap when the sheets are continuously transferred is not constant. In this case, even if transferring of the following sheet is adjusted by using the measuring result, since the transferring time is varied for every sheet, the transferring gap as a result of adjustment is not uniform.

SUMMARY OF THE INVENTION

Accordingly, it is a general object of the present invention to provide a novel and useful sheet transferring device and image forming device solving one or more of the problems discussed above.

A preferred embodiment of the present invention may implement transferring plural sheets at a constant pitch in sequence with a high precision. According to an aspect of the present invention, precision of a constant pitch for continuously transferring plural sheets in sequence at a down stream side of the resist roller may be improved. An embodiment of the present invention may accurately position the sheet by the resist roller against image forming of an imaging system at the image forming device.

More specifically, the embodiments of the present invention may provide a sheet transferring device, including:

a feeding roller configured to feed a sheet;

a transferring roller configured to transfer the sheet to the feeding roller;

a sheet sensor configured to detect the sheet at a sheet transferring part from the transferring roller to the feeding roller;

a measuring part configured to measure an interval of a rear end of a prior sheet and a head end of a following sheet based on a sheet detection signal of the sheet sensor; and a transferring control part configured to adjust a sheet transferring speed of the transferring roller so that the interval between the prior sheet and the following sheet is adjusted to a set value as corresponding to the interval measured by the measuring unit.

The embodiments of the present invention may also provide an image forming device, including:

a sheet transferring device, the sheet transferring device, including:

a feeding roller configured to feed a sheet;

a transferring roller configured to transfer the sheet to the feeding roller;

a sheet sensor configured to detect the sheet at a sheet transferring part from the transferring roller to the feeding roller;

a measuring part configured to measure an interval of a rear end of a prior sheet and a head end of a following sheet based on a sheet detection signal of the sheet sensor; and a transferring control part configured to adjust a sheet transferring speed of the transferring roller so that the interval between the prior sheet and the following sheet is adjusted to a set value as corresponding to the interval measured by the measuring unit;

a sheet feeding tray configured to send out the sheet to the transferring roller; and an image forming part configured to form an image on the sheet sent by the feeding roller.

According to the above-mentioned sheet transferring device or image forming device, by performing feedback control based on the result of measurement of a transferring gap, it is possible to always secure a proper transferring gap even if a use condition is changed or variation with time of a transferring roller is generated. In addition, even if scattering is generated in the transferring gap for every single sheet, it is possible to maintain a uniform transferring gap.

Other objects, features, and advantages of the present invention will become more apparent from the following detailed description when read in conjunction with the accompanying drawings.

DETAILED DESCRIPTION OF THE PREFERED EMBODIMENTS

A description of the present invention is now given, with reference to FIG. 1 through FIG. 8, including embodiments of the present invention.

First Embodiment

Figure 1:
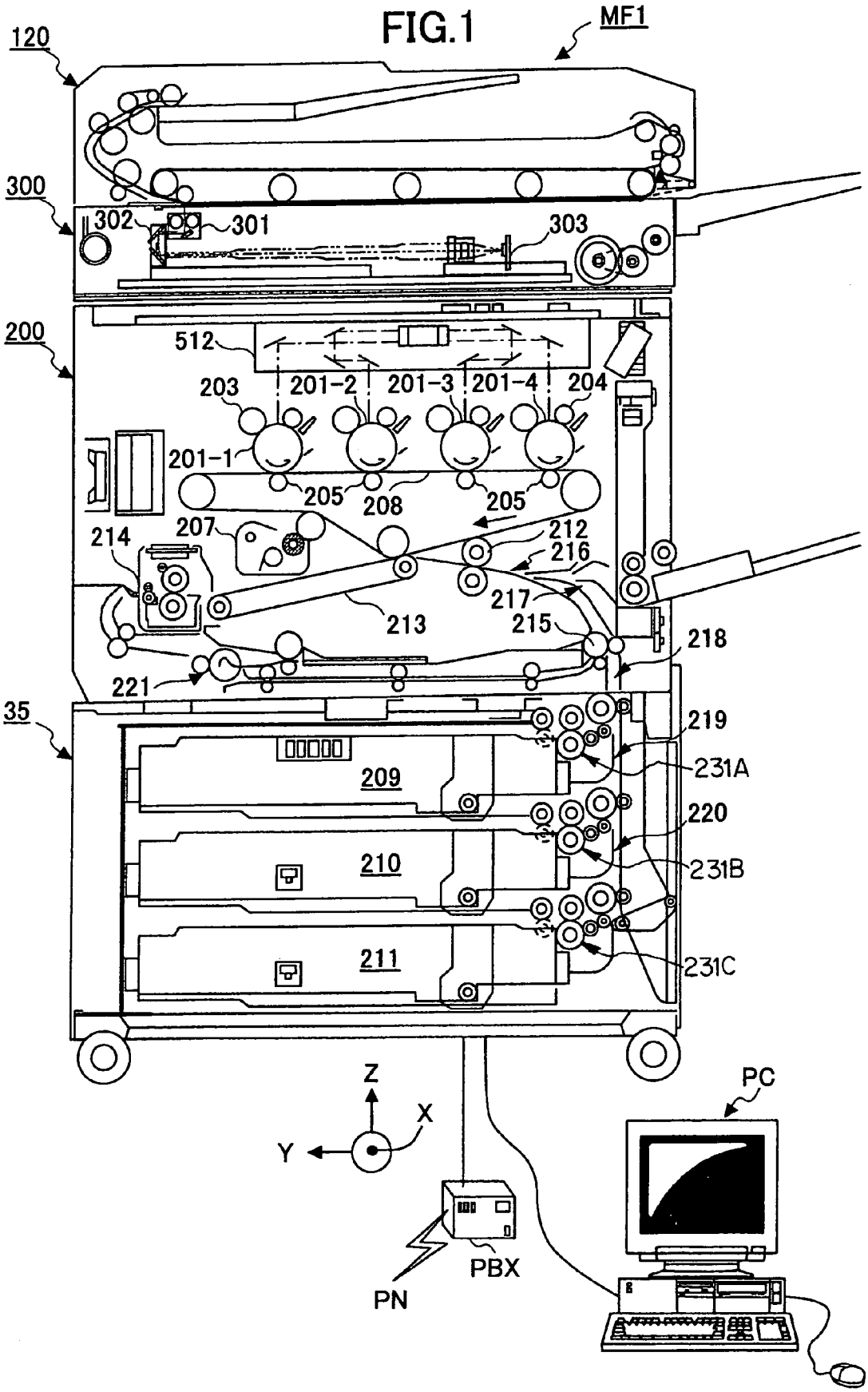
FIG. 1 is a cut-away vertical schematic view of a multi-function full color copier having a sheet transferring device of a first embodiment of the present invention.

FIG. 1 is a cut-away vertical schematic view of a multi-function full color digital copier MF 1 of a first embodiment of the present invention. The full color copier MF1 includes units of, for example, an ADF (Automatic Document Feeder) 120, an operations board 10 (See FIG. 3), a color scanner 300, a color printer 200, and a paper feeding bank 35. A LAN (Local Area Network) to which a personal computer PC is connected is coupled to a system controller 501 (See FIG. 3) in the full color copier MF1. A facsimile controller 506 (See FIG. 3) in the full color copier MF1 can implement facsimile communication via a PBX (Private Branch Exchange) and PN (Public Network).

The printer 200 includes a transferring unit having an endless transferring belt 208. The transferring belt 280 is hung around three supporting rollers and is tensioned by a tension roller so as to be rotated clockwise as shown in FIG. 1. A transferring belt cleaning unit 207 is provided in the vicinity of the tension roller so as to remove a residual toner remaining on the transferring belt 208 after the image is transferred.

Image forming units for forming images of black 201-1, cyan 201-2, magenta 201-3 and yellow 201-4 are arranged at the transferring belt 208 between two of the support roller, along the moving direction of the transferring belt 208. Transfer belt rollers 205 are provided so as to face photosensitive drums situated in the image forming units via the transferring belt 208. A laser exposure unit 512 is provided above the image forming units so as to irradiate laser light for forming images on the photosensitive bodies of the photosensitive units. The photosensitive drums are evenly charged by corresponding charging rollers 204. The laser exposure unit 512 projects laser light modulated by an image signal on a charged surface. An electrostatic latent image generated by this is developed by a developing device 203 so as to become a toner image. This toner image is transferred to the transferring belt 208.

A carriage belt 213 is provided under the transferring belt 206. The carriage belt 213 transfers the toner image on the transferring belt 208 onto the sheet. The sheet where the toner image is transferred is sent out to a fixing unit 214 by the carriage belt 213. Both surfaces driving unit 221 is provided under the carriage belt 213 and the fixing unit 214. A both surfaces driving unit 221 is a sheet reversing unit configured to reverse front and rear a sheet on whose front surface an image is formed and to send the sheet so that another image is recorded on the rear surface.

After a start switch is turned on, if there is a document in the ADF 120, the document is carried on a contact glass of the scanner 300. If there is not a document in the ADF 120, the scanner 300 is immediately driven to read the document manually provided on the contact glass. A first carriage 301 and a second carriage 302 in the scanner 300 are driven to perform scanning. A light is emitted from a light source on the first carriage 301 to the contact glass and a reflection light from a document surface is reflected by a first mirror on the first carriage 301 toward the second carriage 302. The light is reflected by a mirror on the second carriage 302 so that an image is formed on a CCD 303 as a reading sensor via an image forming lens. Based on an image signal obtained by the reading sensor, color recording data of black, cyan, magenta and yellow are generated.

When the start switch is turned on, the transferring belt 208 is driven in the moving direction and preparation for image forming by the units of the image forming device is started so that an image forming sequence of image forming of each color is started. Exposure laser lights modulated based on the color recording data are irradiated onto the photosensitive drums of corresponding colors. Each of the color toner images is transferred onto the transferring belt 208 to form a single image by a color image forming process. When a head end of the toner image enters the conveyance belt 213, the sheet is sent from a resist roller couple 212, namely a sheet feeding roller, to the conveyance belt 213, so that the toner image on the transferring belt 208 is transferred onto the sheet. A voltage for transferring the toner image is applied to the transferring belt 208 by the transfer belt roller 205. The sheet onto which the toner image has been transferred is sent to the fixing unit 214 and then the toner image is fixed to the sheet.

One of paper tray rollers 231A through 231C provided right above paper feeding trays (paper feeding steps or cassettes) 209 through 211 of the paper feeding bank 35 is selectively rotated so that a sheet is sent out from the paper feeding trays 209 through 211 of the paper feeding bank 35. Only a single sheet is separated by a separating roller 232 so as to be taken into a conveyance roller unit provided in a vertical direction. The sheet is led to a transferring part in the printer 200 so as to be transferred to the resist roller couple 212 by the conveyance roller 215 of the conveyance path. After the head end of the sheet comes in contact with the resist roller couple 212 and is stopped, the resist roller couple 212 and the conveyance roller 215 are rotated at the designated timing so that the sheet is sent to the conveyance belt 213.

Alternatively, the sheet may be taken in a manual tray situated at a right front end for paper feeding. If the user puts the sheet in the manual tray, the printer 200 rotates the paper feeding roller of the manual tray part so that a single sheet in the manual tray is separated and taken in the manual paper feeding path. The head end of the sheet comes in contact with the resist roller couple 212 and is stopped.

The fixing process is applied to the sheet by the fixing unit 214 and then the sheet is discharged. The sheet is guided to a paper discharge roller by a switching claw so as to be stacked on the paper discharge tray (not shown). Alternatively, the sheet is guided to the both surfaces driving unit 221 by the switching claw (not shown) and is revered there. And then, the sheet is led to a transferring position again. After the image is recorded on the rear surface, the sheet is discharged to the paper discharge tray by the paper discharging roller (not shown). On the other hand, the residual toner remaining on the transferring belt 208 after the image is transferred is removed by a transferring belt cleaning unit 207, so that the next image forming operation is prepared for.

Figure 2:
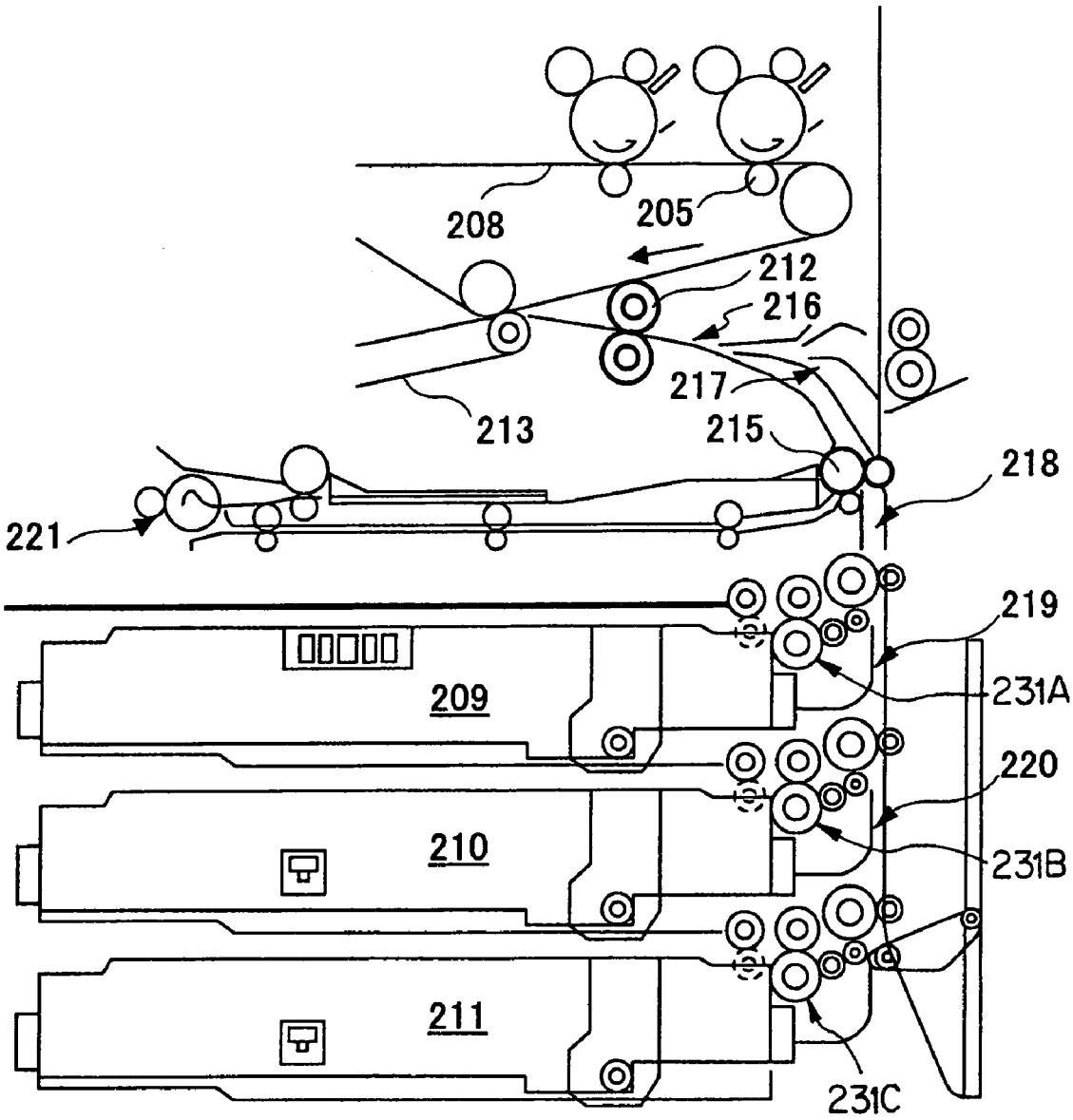
FIG. 2 is an expanded view showing a sheet transferring mechanism part shown in FIG. 1.

FIG. 2 is an expanded view of a carriage path from the paper feeding trays 209 through 211 to the conveyance belt 213. A sheet sensor (resist sensor) 216 is provided in the vicinity of the resist roller 212. A sheet sensor 217 is provided between the resist sensor 216 and the conveyance roller 215 so as to measure a gap between a sheet and the following sheet. Other sheet sensors 218 through 220 detect sheets sent out from the paper feeding trays 209 through 211. If the sheet sensor detects the sheet within a designated period from starting sending the sheet, it is determined that the sheet can be sent out. If the sheet sensor does not detect the sheet within a designated period from starting sending the sheet, it is determined that there is an error in sending out the sheet.

Referring back to FIG. 1, the resist roller 212 is connected to a main drive system configured to drive the photosensitive bodies, the transferring belt 208, the conveyance belt 213 and the fixing device 214 via a clutch. By turning on the clutch, the resist roller 212 is rotated. However, the conveyance roller 215 is connected to a tray paper feeding drive system independent from the main drive system. The paper feeding rollers and sending rollers of the paper feeding trays 209 through 211 are connected to the tray paper feeding drive system by the clutches provided to every tray and are rotated by turning on the clutches. As power sources of the main drive system and the tray paper feeding drive system, electric motors are used. When printing or copying is started, the tray paper feeding drive system is energized so that the sheet having a designated size is sent out from the paper feeding tray and the main drive system is driven so that image forming on the photo sensitive body is started. However, the resist roller 212 is stopped due to the clutch being off.

After the sheet is sent from the paper feeding tray, detected by the resist sensor 216, and transferred by the designated amount, that is, at the timing when the head end of the sheet comes in contact with the resist roller 212 so as to bend the sheet in a designated curved shape, power to the tray paper feeding drive system (conveyance roller 215) is stopped so that the sheet is stopped. At a setting timing right after that, the head end of the sheet is consistent with the position of the toner image on the transferring belt 208 relative to a position of a transfer belt roller 205 pushing the transferring belt 208 to contact the conveyance belt 213.

By turning on the clutch, the resist roller 212 is driven, the sheet whose head end comes in contact with the resist roller 212 is sent to the conveyance belt 213, and the tray paper feeding drive system (conveyance roller 215) is restarted. As a result of this, the head end of the sheet is overlapped with (matches) an image head end of the transferring belt 208 at the position of the transferring roller pushing the transferring belt 208 to contact the conveyance belt 213. In a case of continuous printing or copying of plural sheets, after a rear end of the sheet sent by the resist roller 212 passes the conveyance roller 215, the following sheet is sent from the paper feeding tray at a designated timing for making the head end of the following sheet reach the conveyance roller 215 when the sheet moves at designated gap amount. At the timing when the rear end of the prior sheet passes through the resist roller 212, the clutch is turned off so that the rotation of the resist roller 212 is stopped.

Figure 3:
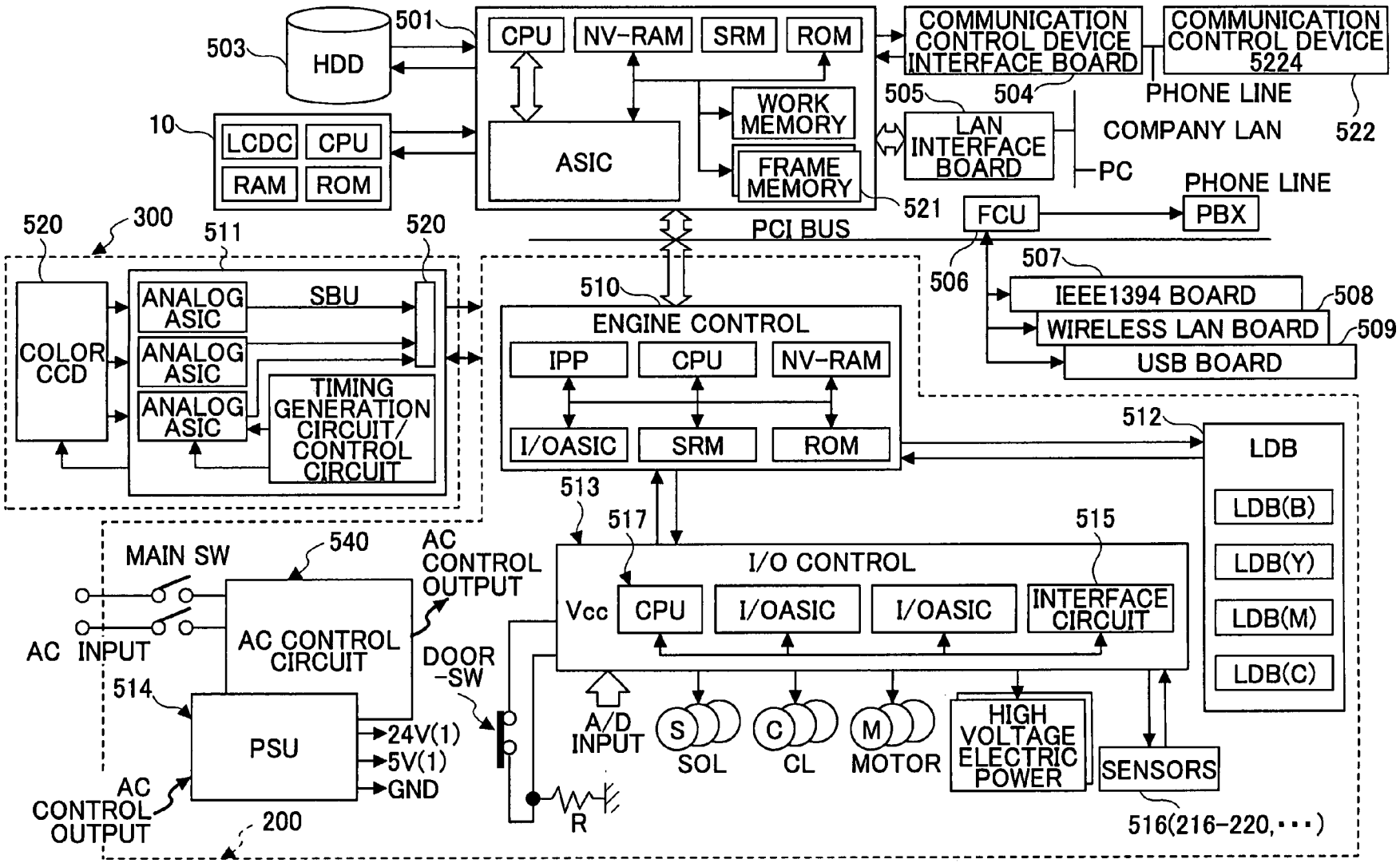
FIG. 3 is a block diagram of an image processing system of the copier shown in FIG. 1.

FIG. 3 is a view showing a system structure of an electric equipment system of a multi-function copier MF1 shown in FIG. 1.

The electric equipment system includes a system controller 501, an operations board 10 of the image forming device connected to the controller 501, a HDD 503, a communication control device interface board 504, a LAN interface board 505, a control unit 506 of a facsimile, an IEEE 1394 board 507, a wireless LAN board 508, a USB board 509 and others connected to a general purpose PCI bus, an engine control part 510 connected to the controller by the PCI bus, an I/O board 513 connected to the engine control part 510, an SBU (Sensor Board Unit) 511, an LDB (Laser Diode Board) 512, and others.

The system controller 501 controls the entire image forming device. The HDD 503 stores image data. The communication control device interface board 504 communicates to the outside by using an analog circuit. The I/O board 513 controls I/O of the image forming device. The SBU 511 reads a copy document (image). The LDB 512 projects (optically writes) an image light of the image data on the photosensitive body drum.

The color scanner 300 configured to optically read the document scans a document with a light source and forms a document image on a CCD 520. The document image, namely a reflection light of light irradiation against the document is photo-electrically converted so that image signals of R, G and B are generated.

A communication control device interface board 504 immediately reports to an outside remote checking device if a problem occurs in the image forming device so that a service person can recognize the contents or status of a malfunctioning part and repair it soon. The communication control device interface board 504 is also used for transmitting the use status of the image forming device.

The CCD 520 shown in FIG. 3 is a 3-line color CCD. The CCD 520 generates the image signals of R, G and B of EVENch (even number pixel channels)/ODDch (odd number pixel channel) so as to input the image signals to the corresponding analog ASICs (Application Specific ICs) of the SBU board. The SBU board 511 includes a circuit generating a driving timing of the CCD, and the analog ASICs. An output of the CCD 520 is held by a sample holding circuit inside the analog ASIC and then A/D converted. This output of the CCD 520 is converted into the image data of R, G and B and shading correction is implemented. This output is sent to an IPP (Image Processing Processor) via an image data bus by an output I/F (interface).

The IPP is a programmable computing processor configured to implement an image process. The IPP implements separation and generation, namely determination that the image is a character area or a picture area (image area separation), a base material removal, scanner gamma conversion, filtering, color correction, varying magnification ratio, image processing, a printer gamma conversion and gradation process. An optical system and signal degradation (signal degradation of the scanner system) accompanied with quantization of a digital signal are corrected in the IPP so that the image data transferred from the SBU to the IPP are stored in a frame memory 521.

The system controller 501 includes a ROM, RAM, NV-RAM, SRAM, ASIC and interface circuit. The ROM supports a CPU and a system controller board. The RAM is a working memory which the CPU uses. A lithium battery, backup of the SRAM and a clock are installed in the NV-RAM. The ASIC controls the periphery of the CPU such as FIFO, the flash memory, and the system bus of the system controller board.

The system controller 501 includes functions of plural applications such as a scanner application, facsimile application, printer application, copier application, and others so as to control the entire system. The system controller 501 reads an input through the operations board 10 and displays settings of the system and status contents on a display part of the operations board 10.

A large number of units are connected to the PCI bus so that image data and control commands are transferred by the image data bus/control command bus in a time divisional way.

The communication control device interface board 504 is a communication interface board between the communication control device 552 and the system controller 501. The communications between the communication control device interface board 504 and the controller 501 are made by full duplex asynchronous serial communication. The communication control device interface board 504 is multi-drop connected to the communication control device 522 by an RS-485 interface standard. Communications with a remote managing system are implemented via the communication control device interface board 504.

A LAN interface board 505 is connected to a company LAN. The LAN interface board 505 is a communication interface board between the company LAN and the controller 501 and includes a PHY chip. The LAN interface board 505 and the controller 501 are connected by a standard communication interface of the PHY chip I/F and I2C bus I/F. Communications with outside apparatuses are implemented via the LAN interface board 505.

The HDD 503 is used as an image database which stores an application program of the system, the application database, the image data of the read image or stored image, and document data. The application database stores device energizing information of the printer or the image forming process device. The HDD 503 is connected to the controller 501 by an interface in accordance with ATA/ATAPI-4 together with a physical interface or electrical interface.

The operations board 10 includes a CPU, ROM, RAM, LCD and ASIC (LCDC) configured to control key inputs. A control program of the operations board 10 is stored in the ROM. The control program controls input to the operations board 10 and output to the display LCDC. The RAM is an operation memory used by the CPU. By the operations board 10 via the communications with the system controller 501, an input of a system setting, display of the set contents and status of the system to the user, and a control of the inputs are implemented.

The writing signals of black, yellow, cyan, magenta, the writing signals being output from the working memory of the system controller 501, are input to LD (Laser Diode) writing circuits of black, yellow, cyan, magenta, respectively, of an LDB (Laser Diode control Board). LD electrical current control (modulation control) is implemented by the LD writing circuit so as to be output to the LDs.

The engine control 510 mainly controls an image forming generation. The engine control 501 includes a CPU, an IPP configured to implement an image process, a ROM storing a program necessary for controlling copying and printing, a RAM necessary for other control, and an NV-RAM. The NV-RAM includes a memory for storing when turning off the power is detected. The I/O ASIC includes a serial interface for sending and receiving a signal with the CPU for other control functions. The I/O ASIC controls a nearby I/O where an engine control board is mounted, such as counter, fan, solenoid, motor, or the like. The I/O control board 513 and the engine control board 510 are connected by synchronous serial interface.

A sub CPU 517 is mounted in the I/O control board 513. The I/O control board 513 implements an analog control of a P sensor, T sensor, or the like, a jam detection referring a detection signal of the sheet sensor, and the I/O control of the image forming device including a sheet transmitting control. The interface circuit 515 has various sensors and an actuator such as a motor, a clutch, or solenoid.

The electric power source unit PSU 514 supplies electric power for controlling the image forming device. Commercial electric power is supplied by turning on the main SW. Commercial AC is supplied from the commercial electric power source to the AC control circuit 540. By using AC power rectified and smoothed by the AC control circuit 540, a first electric power source unit (1) 514 supplies DC voltage necessary for control boards. CPUs of control parts are operated by using a constant voltage generated by the electric power source unit 514.

Figure 4:
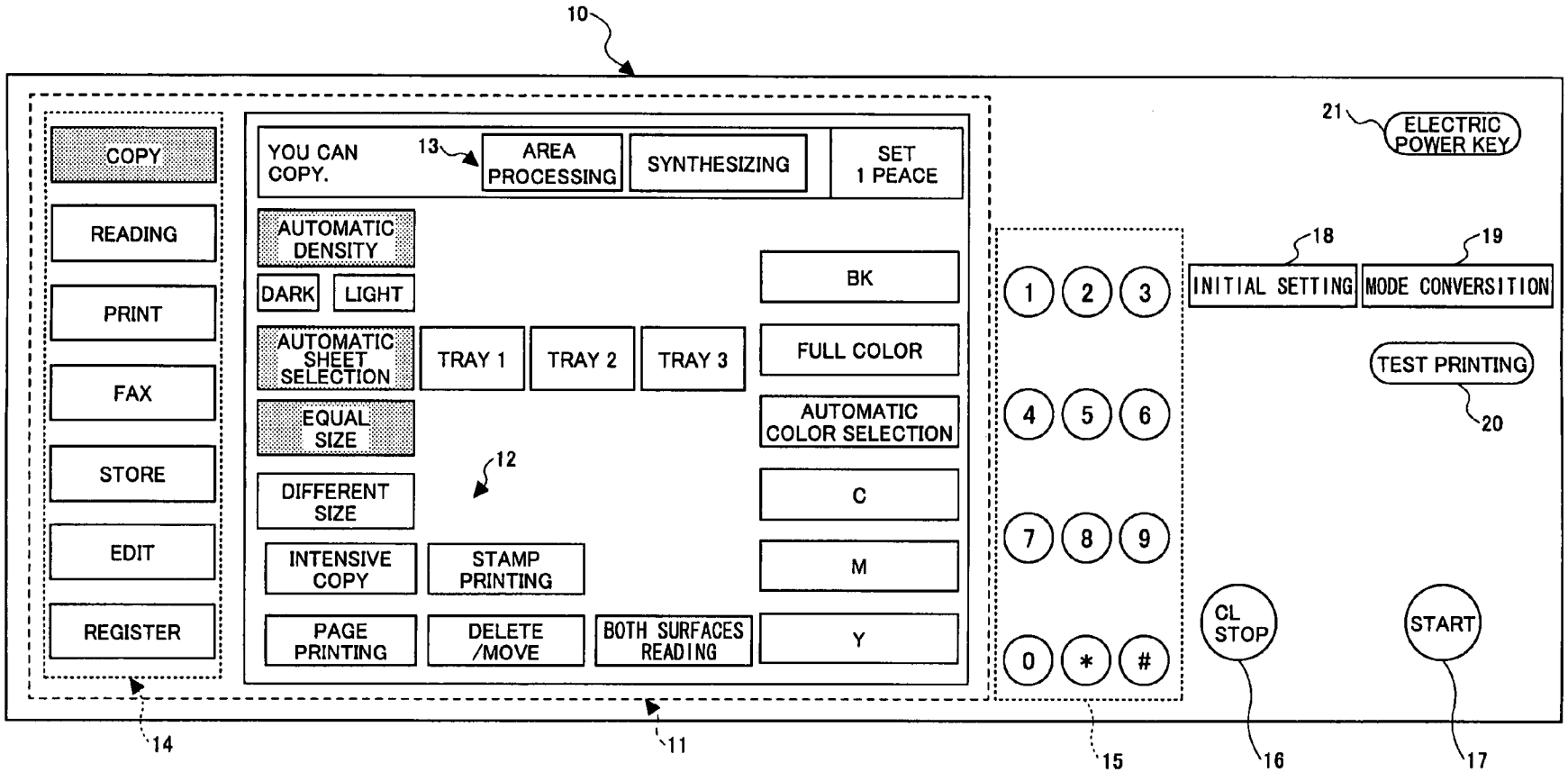
FIG. 4 is an expanded plan view of an operations board 10 shown in FIG. 3.

FIG. 4 is an expanded plan view of the operations board 10 shown in FIG. 3. As shown in FIG. 4, the operations board 10 has a liquid crystal touch panel 11, ten keys 15, clear/stop key 16, start key 17, initialization setting key 18, mode switching key, test printing key 20, and power key 21. In addition, an alphabetic key board (not shown in FIG. 4) may be provided. Japanese Hiragana characters can be inputted by the alphabetic keyboard, thereby setting, registering of a URL, sentences for e-mail, file name, folder name, or the like is achieved.

The power key 21 is an operations key configured to instruct switching from an energy saving mode (stand-by mode or energy-saving mode) to a stand-by mode wherein image printing can be performed, and vice versa. If the power key 21 is pressed when the energy saving mode is set, the energy saving mode is switched to the stand-by mode. If the power key 21 is pressed when the stand-by mode is set, the stand-by mode is switched to the stop mode. A test printing key 20 is for printing one copy of a document regardless of the selected number of copies to print and for checking the result of the printing.

By pressing the initialization setting key 18, it is possible to optionally customize the initial settings of the device. It is possible to optionally select a setting when a reset key of a copy function is set. For example, a transition time to the energy saving mode can be set, an update interval of the image output correction can be set, a sheet size of a sheet stored in the device can be set, or a resist stopping timing Lst and a following sheet speed adjusting gain Gfp can be set.

If the initialization setting key 18 is operated, a selection button for designated an "initial value setting" function for setting various initial values, "ID setting" function, "copyright registration/setting" function, "output of usage result" function, or the like. In the "initial value setting" function, there is setting (change) of the resist stopping timing Lst and a following sheet speed adjusting gain Gfp.

In the liquid touch panel 11, various function keys and a message indicating operating states of the engine 300 and the control board 400 are indicated.

The function selection key 14 is displayed in the liquid crystal touch panel 11. The function selection key 14 indicates selection or implementation of "copying" function, "scanner" function, "printer" function, "facsimile" function, "storage" function, "editing" function, "registration" function, and other functions.

An input and output picture defined by a function designated by the function selection key 14 is displayed. For example, when the "copying" function is designated, as shown in FIG. 4, the function key 12 and a message 13 indicating the number of copied papers and the status of the image forming device are displayed.

When the operator touches a key displayed on the liquid crystal touch 11, the operations board 10 reads the touch as an operator input so that the selected key is reverse-displayed in gray color indicating the designation. In addition, if details of the function, such as kinds of page printing, have to be designated, by touching the key, a setting picture of detailed functions is pop-up displayed. Thus, since the liquid crystal touch panel 11 uses a dot display, it is possible to graphically perform a proper display. In the function keys 12, there are printing color designation keys of "Black (BK)", "Full Color", "Automatic Color Selection", "Cyan (C)", "Magenta (M)" and "Yellow (Y)".

Figure 5:
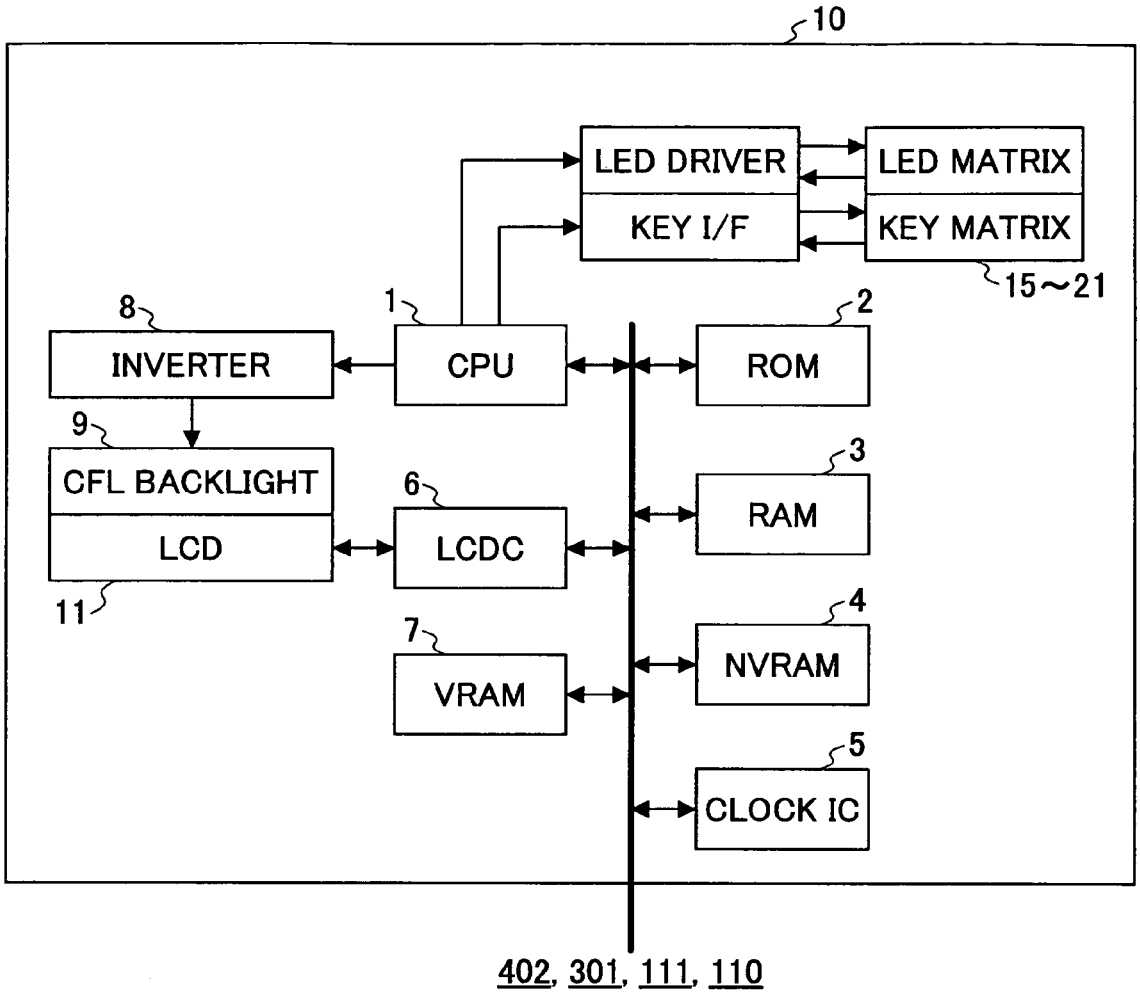
FIG. 5 is a block diagram of an input and output process system of the operations board 10 shown in FIG. 4.
Figure 6:
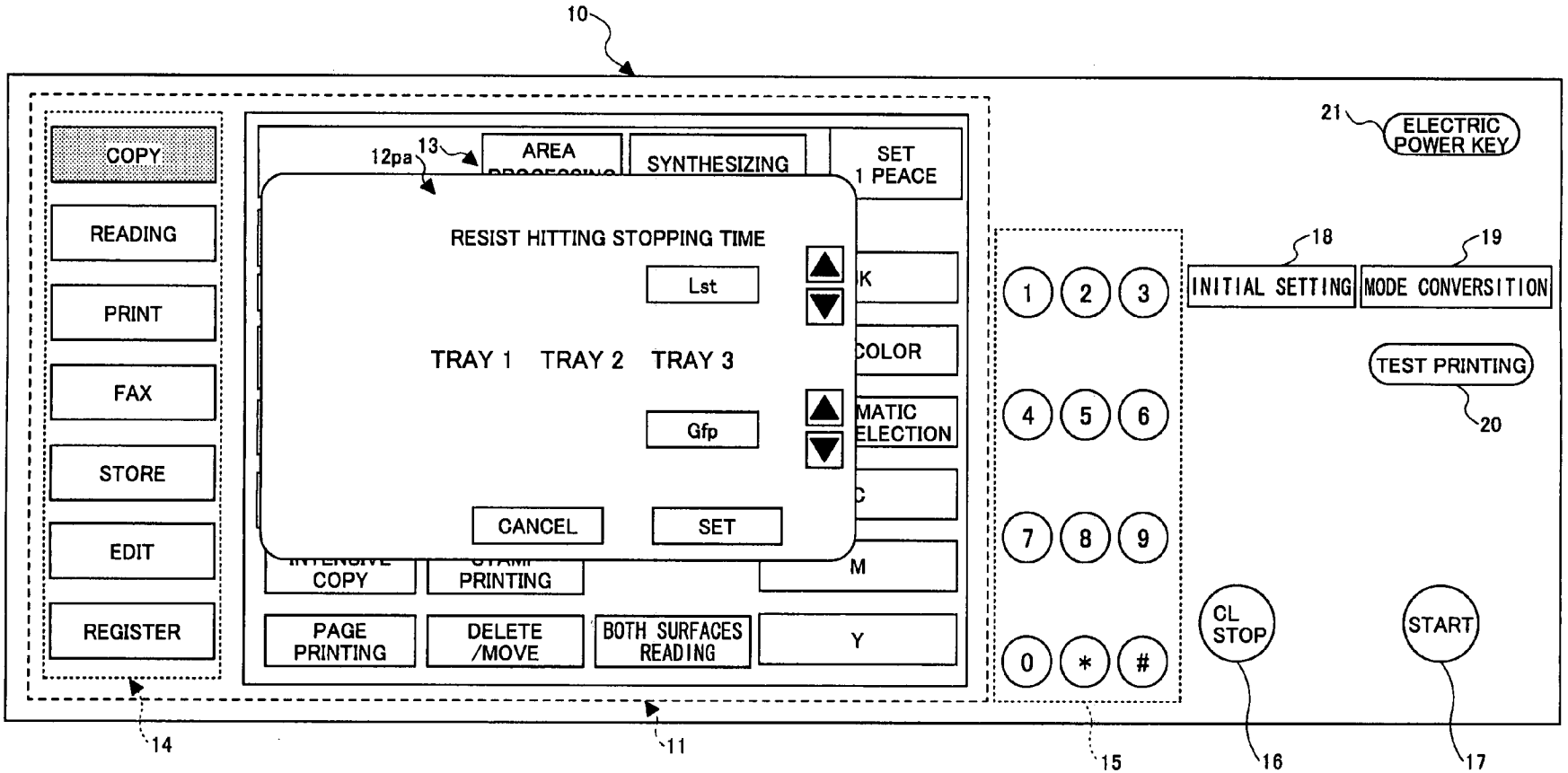
FIG. 6 is a plan view showing an input and output screen of the operations board 10, the input and output screen being where a resist stopping timing Lst and a following sheet speed adjustment gain Gfp are set.

FIG. 5 is a block diagram of an input and output processing system of the operations board 10 shown in FIG. 4.

A main part of an electric control system of the operations board 10 includes a CPU 1, a ROM 2, a RAM 3, a VRAM 7, a LCDC (Liquid Crystal Display Controller) 6, a clock IC 5, and others. The CPU 1 communicates with the system controller 501 and the CPU of the engine control 510, reads out the input by the operations board 10, and controls the display on the operations board 10. The control program of the CPU 1 is stored in the ROM 2. The RAM 3 stores data for a time at the time of controlling. Imaging data of the liquid crystal touch panel 11 are stored in the VRAM 7. The LCDC 6 connected to the VRAM 7 implements imaging timing control of the liquid crystal touch panel 11 and a touch input detection. The clock IC 5 generates clock data. The liquid crystal touch panel 11 having a light source of the CFL as a backlight 9 is connected to the LCDC 6. An inverter 8 driving the CFL backlight 9, key matrixes of operation key groups 15 through 21, an LED matrix of the display LED, and an LED driver driving the LEDs are connected to the CPU 1. A non-volatile RAM (NVRAM) 4 is connected to the data bus connected to the CPU 1. The NVRAM 4 is used for an image process mode and for storing an initial setting value.

The CPU 1 of the operations board 10 detects pressing of each keys, and generates corresponding signal according to the pressed key. Then, the CPU 1 transfers a start instruction to the controller board 400 in response to the press of the start key.

The resist stopping timing Lst and a following sheet speed adjusting gain Gfp can be input by the operations board 10. An input value is registered in the NVRAM shown in FIG. 5.

When the CPU 1 detects the operation of the initial setting key 18 in the operation key groups 15 through 21, the setting menu is displayed in the liquid display touch panel 11. If the operator designates items of the sheet transmitting adjustment on the setting menu and designates items of the resist stopping timing and the following sheet speed adjusting gain in the sheet transmitting adjustment, the CPU 1 displays a setting picture 12*pa* of the resist stopping timing and the following sheet speed adjusting gain shown in FIG. 6 on a part of a display of the liquid crystal touch panel 11.

The operator operates an up/down button on the setting picture 12*pa* so that the resist stopping timing Lst and a following sheet speed adjusting gain Gfp can be adjusted.

When the operator operates the "setting" button, the CPU 1 stores the displayed values Lst and Gfp in the NVRAM 4 and transfers the Lst and Gfp to the engine control 510 via the system controller 501. The engine control 510 sends the Lst and Gfp to the CPU 517 of the I/O control 513. The CPU 517 changes the Lst and Gfp held in inside registers to the Lst and Gfp sent by the engine control 50.

Figure 7:
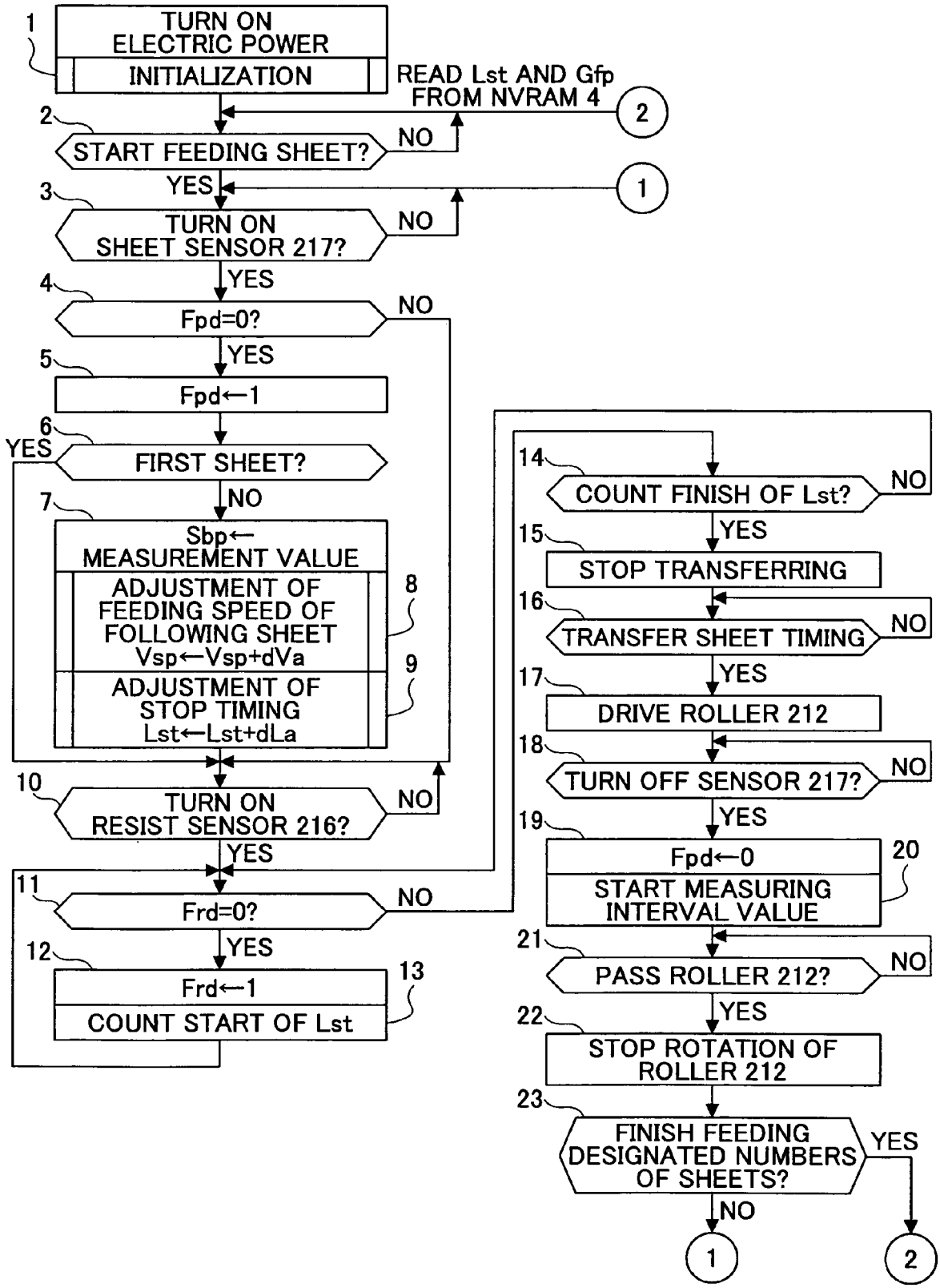
FIG. 7 is a flowchart of a sheet gap control process of a CPU 517 of an I/O control 513 shown in FIG. 4.
Figure 8:
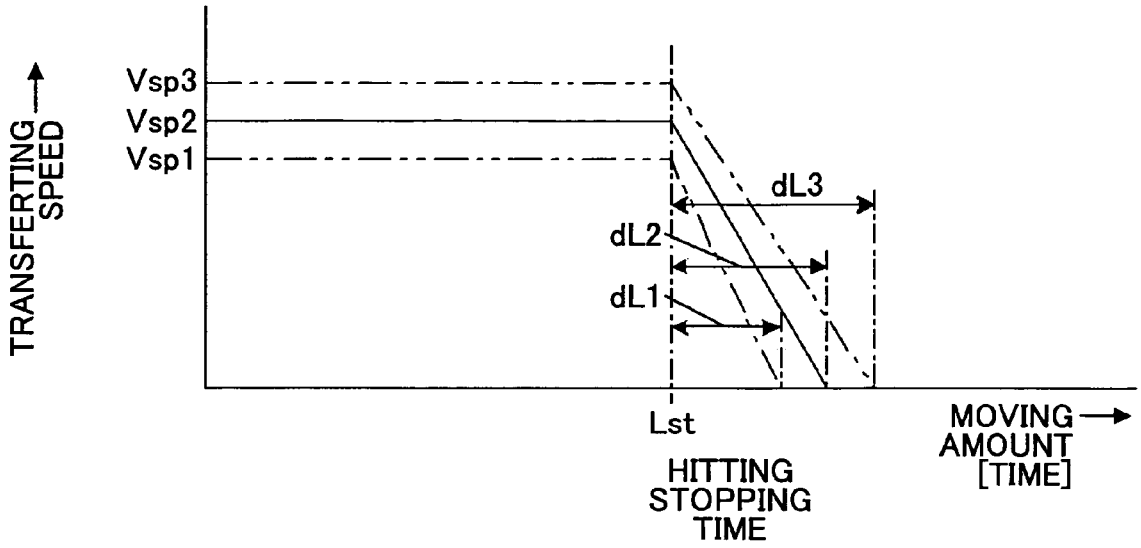
FIG. 8 is a graph showing a relationship between a moving amount of a sheet from when a head end of a sheet hits a resist roller so that the transferring driving of the sheet is stopped to when the sheet is stopped, and a transferring speed.

FIG. 7 is a flowchart of a sheet gap control process of a CPU 517 of an I/O control 513 shown in FIG. 4.

Just after electric power is turned on so that an operating voltage is applied to the printer 200, the CPU 517 initializes the I/P control 513 in step 1.

As responding to completing the initialization of the I/O control 513, the engine control 510 sets the resist stopping timing Lst and the following sheet speed adjusting gain Gfp in the data group read by the NVRAM 4 of the operations board 10 via the system controller 501 just after the initialization in the CPU 517 of the I/O control 513. That is, the Lst and Gfp are sent to the CPU 517 and the CPU 517 store the Lst and Gfp in the inside registers.

After that, the CPU 517 waits for the start of paper feeding (step 2). After paper feeding is started, when the sheet sensor 217 detects the sheet (step 3) so that a detection signal of the sheet sensor 217 is changed to paper non-existence to paper existence, data of the register Fpd is changed from "0" indicating non-detection of the sheet to "1" indicating detection of the sheet (steps 4 and 5).

In a case of a first sheet, when the resist sensor 216 detects the sheet (step 10), "1" indicating that the sheet is detected by the resist sensor 216 is stored in the register Frd (steps 11 and 12) so that a count of the moving amount of the sheets from the resist sensor 216 is started (step 13). In this embodiment, a count of a moving synchronized pulse (one pulse moving synchronized signal per designated unit amount of moving) of the transferring belt 208 is started. However, since the moving speed of the transferring belt 208 is constant, the clock pulse may be counted.

When the count value becomes the resist stopping timing Lst (steps 11 through 14), the transferring of the sheet by the transferring roller 215 is stopped (step 15). The resist stopping timing is defined that the sheet is stopped on the transferring way for skew adjustment. When it is the transfer paper feeding timing, which is a starting timing for sending the sheet to the transferring belt 208 and the conveyance belt 213, the resist roller 212 is driven (steps 16 and 17). That is, sending the sheet sending from the resist roller 212 to the transferring belt 208 is started.

After the rear end of the sheet passes through the sheet sensor 217 (step 18), the CPU 517 changes the data of the register Fpd from "1" indicating detection of the sheet to "0" indicating non-detection of the sheet (step 19) so that measurement of the gap between the rear end of the prior sheet and the head end of the following sheet is started (step 20). In this embodiment, the count of the moving synchronized pulses of the transferring belt 208 is started. However, since the moving speed of the transferring belt 208 is constant, the clock pulse may be counted.

Next, at the timing when the rear end of the sheet passes through the resist roller 212, the CPU 517 stops driving the resist roller 212 (steps 21 and 22). When the second sheet is fed, the CPU 517 returns to step 3. When the head end of the following sheet arrives at the sheet sensor 217, data of the register Fpd are changed to "1" (steps 4 and 5).

A value of the measurement of the gap between the rear end of the prior sheet and the head end of the following sheet started in step 20 is stored in the register Sbp (step 7). The transferring speed Vsp of the conveyance roller 215 (tray paper feeding drive system) is adjusted to a speed correcting the gap to a set value based on the data Sbp stored in the register Sbp (step 8). The resist stopping timing Lst of the sheet is adjusted (step 9) so that the head end part of the transferred sheet hitting the resist roller 212 forms a designated curve even if the sheet is transferred at an adjusted speed.

In this embodiment, "Sbp-setting value", namely the deviation of the gap value Sbp measured against the setting value, is used in adjustment of the transferring speed Vsp. The product dVa of a ratio of the deviation "Sbp-setting value" against a moving distance until when the head end of the following sheet hits the resist roller 212, namely a sheet moving distance (fixing value) between the sensor 217 and the resist roller 212, and the adjustment gain Gfp of the register Gfp is calculated. This, as the adjust value, is added to the object speed Vsp of the register Vsp and the added value is newly stored in the register Vsp. Speed setting of the tray paper feeding drive system, namely the conveyance speed setting of the conveyance roller 215, is performed by using the added value as an object speed. When the deviation "Sbp-setting value" is a positive value, the conveyance speed of the conveyance roller 215 is increased. When the deviation "Sbp-setting value" is negative value, the conveyance speed of the conveyance roller 215 is decreased.

Adjustment of the stop timing (step 9) takes into account that the head end of the sheet has a designated curve, that is, the sheet length between the conveyance roller 215 and the resist roller 212 is constant when the head end of the sheet hits the resist roller 212 so that driving of the conveyance roller 215 is stopped.

The purpose of stopping the sheet at the resist roller 212 so as to make the head end curved is to correct skew (position shift) of the sheet. The purpose of stopping transferring the sheet for a while is to be capable of securely positioning the sheet against the image on the transferring belt 208. When the head of the sheet hits the resist roller 212 so that the transferring is stopped, if the transferring speed differs such as Vsp1 through Vsp3, a time from when the sheet hits the resist roller 212 to when the sheet stops, namely a moving amount of the sheet, varies such as dL1 through dL3. This may change the curved configuration of the head end of the sheet and cause inaccuracy to the skew correction. In addition, this may cause scattering (variation) of the feeding speed of the sheet (more specifically, the head end of the sheet) at the time when the resist roller 212 is driven so that image shift may be caused.

Therefore, in this embodiment, at the time of adjustment of the stop timing (step 9), a timing adjustment value dLa corresponding to the deviation "object value-standard value" of the adjusted transferring speed object value against the standard transferring speed is calculated. The timing adjustment value dLa is added to the data Lst of the register Lst so that the added value is newly stored in the resister Lst. This added value is used for the moving synchronized pulse count value Lst in steps 13 and 14 from when the head end of the sheet is detected by the resist sensor 216 to when the sheet feeding by the conveyance roller 215 is stopped.

When the deviation "object value-standard value" is positive, the count value Lst is small. When the deviation "object value-standard value" is negative, the count value Lst is large.

A process after the adjustment of stop timing is the same as that of the first sheet transferring.

By the sheet gap control of the CPU 517, the second and later sheet transferring of plural sheets for continuous printing or copying is performed in steps 7 and 8. Therefore, the transferring speed Vsp of the transferring roller 215 is adjusted so that the interval between transferring sheet is made constant. In addition, the transferring stop timing Lst of the transferring roller 215 is adjusted so that the sheet length between the transferring roller 215 and the resist roller 212, when the head end of the sheet hits the resist roller 212 and thereby the sheet transferring is stopped, is made constant.

According to the above-mentioned embodiment of the present invention, it is possible to provide a sheet transferring device, including:

a feeding roller 212 configured to feed a sheet;

a transferring roller 215 configured to transfer the sheet to the feeding roller 212;

a sheet sensor 217 configured to detect the sheet at a sheet transferring part from the transferring roller 215 to the feeding roller 212;

a measuring part 513 configured to measure an interval of a rear end of a prior sheet and a head end of a following sheet based on a sheet detection signal of the sheet sensor 217; and a transferring control part 517 configured to adjust a sheet transferring speed of the transferring roller 215 so that the interval between the prior sheet and the following sheet is adjusted to a set value as corresponding to the interval measured by the measuring unit 513.

According to this sheet transferring device, by implementing feed-back control based on the measurement of the transferring interval, even if the using enviroment is changed or variation with time of the transferring roller is generated, it is possible to always secure a proper transferring interval. In addition, even if there is unevenness of the transferring interval for every sheet, it is possible to secure a uniform transferring interval.

The transferring control part 517 may adjust a timing Lst when the transferring roller is stopped for a while after the head end of the sheet transferred by the transferring roller 215 reaches the stopped feeding roller 212, as corresponding to adjustment of the sheet transferring speed, so that a sheet length between the feeding roller 212 and the transferring roller 215 when the transferring roller 215 is stopped is adjusted to the set value.

In the sheet transferring device wherein the head end of the sheet is fed to the feeding roller 212 so that the sheet position is corrected, even if the transferring speed changes, it is possible to constantly correct the sheet position correction.

The sheet transferring device may further include an input part 10 configured to set the set value of the sheet length between the feeding roller and the transferring roller by an operator.

As corresponding to variation with time of the sheet transferring property or change of kinds of the sheets, it is possible to properly adjust the setting value.

According to the above-mentioned embodiment of the present invention, it is possible to provide, as shown in FIG. 1, an image forming device, including a sheet transferring device as discussed above; a sheet feeding tray 209 through 211 configured to send out the sheet to the transferring roller 215; and an image forming part 204, 512,205,208,213,214 configured to form an image on the sheet sent by the feeding roller 212.

The image forming part may be an electrophotographic type image forming device whereby a toner image is formed on a photosensitive body and the toner image is transferred to the sheet directly or via an intermediate transferring body; and the feeding roller 212 may be a resist roller configured to feed the sheet to a transferring part of the image forming device, the transferring part being configured to transfer the toner image onto the sheet.

The resist roller 212 may be connected to a photosensitive body driving power system via a clutch; and the transferring roller 215 may be driven by a tray feeding drive system separated from the photosensitive body driving power system.

The number of the feeding trays 209 through 211 may be plural, and the sheet sensor 217 may be provided at a common transferring part where any of the sheets sent from the feeding trays 209 through 211 passes.

Even if plural paper feeding trays are provided, the transferring interval is measured and controlled to a setting value at a common transferring part after the papers from trays are merged. Therefore, it is not necessary to provide a measuring device of the transferring interval for every paper feeding tray. Hence, it is possible to achieve maximum effect at low cost.

The transferring roller 215 may be provided at the common transferring path.

The image forming device may further include an imaging part 300 configured to image an image and convert the image to image data, wherein the imaging part 300 may form an image indicated by the image data generated by the imaging part 300, on the sheet fed by the feeding roller 212.

The present invention is not limited to the above-discussed embodiments, but variations and modifications may be made without departing from the scope of the present invention.

This patent application is based on Japanese Priority Patent Application No. 2005-136153 filed on May 9, 2005, the entire contents of which are hereby incorporated by reference.

What is claimed is:

1. A sheet transferring device, comprising:

a feeding roller configured to feed a sheet;

a transferring roller configured to transfer the sheet to the feeding roller;

a sheet sensor configured to detect the sheet at a sheet transferring part from the transferring roller to the feeding roller;

a measuring part configured to measure an interval between a rear end of a prior sheet and a head end of a following sheet passing through the sheet sensor; and a transferring control part configured to determine, using the interval measured by the measuring part, an amount of deviation of the interval between the prior sheet and the following sheet from a set value and adjust a sheet transferring speed of the transferring roller based on the determined amount of deviation, wherein the transferring control part adjusts a timing for stopping the transferring roller after the head end of the sheet transferred by the transferring roller reaches the feeding roller that is stopped, as corresponding to adjustment of the sheet transferring speed, so that a sheet length between the feeding roller and the transferring roller, when the transferring roller is stopped, is adjusted to the set value.

2. The sheet transferring device as claimed in claim 1, further comprising:

an input part configured to set the set value of the sheet length between the feeding roller and the transferring roller by an operator.

3. An image forming device, comprising:

a sheet transferring device, the sheet transferring device, including:

a feeding roller configured to feed a sheet, a transferring roller configured to transfer the sheet to the feeding roller, a sheet sensor configured to detect the sheet at a sheet transferring part from the transferring roller to the feeding roller, a measuring part configured to measure an interval between a rear end of a prior sheet and a head end of a following sheet passing through the sheet sensor, and a transferring control part configured to determine, using the interval measured by the measuring part, an amount of deviation of the interval between the prior sheet and the following sheet from a set value and adjust a sheet transferring speed of the transferring roller based on the determined amount of deviation;

a sheet feeding tray configured to send out the sheet to the transferring roller; and an image forming part configured to form an image on the sheet sent by the feeding roller, wherein the transferring control part adjusts a timing for stopping the transferring roller after the head end of the sheet transferred by the transferring roller reaches the feeding roller that is stopped, as corresponding to adjustment of the sheet transferring speed, so that a sheet length between the feeding roller and the transferring roller, when the transferring roller is stopped, is adjusted to the set value.

4. The image forming device as claimed in claim 3, further comprising:

an input part configured to set the set value corresponding to the sheet length between the feeding roller and the transferring roller by an operator.

5. The image forming device as claimed in claim 3, further comprising:

an imaging part configured to image an image and convert the image to image data, wherein the imaging part forms an image indicated by the image data generated by the imaging part, on the sheet fed by the feeding roller.

* * * * *